US011020677B2

(12) United States Patent
Blum et al.

(10) Patent No.: US 11,020,677 B2
(45) Date of Patent: Jun. 1, 2021

(54) SCENIC COMPARTMENT RIDE SYSTEMS AND METHODS

(71) Applicant: Universal City Studios LLC, Universal City, CA (US)

(72) Inventors: Steven C. Blum, Orlando, FL (US); Lisa Marie Levy, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/786,658

(22) Filed: Feb. 10, 2020

(65) Prior Publication Data

US 2020/0254352 A1 Aug. 13, 2020

Related U.S. Application Data

(63) Continuation of application No. 16/421,609, filed on May 24, 2019, now Pat. No. 10,632,390.

(60) Provisional application No. 62/805,191, filed on Feb. 13, 2019.

(51) Int. Cl.
*A63G 31/02* (2006.01)
*A63G 31/16* (2006.01)

(52) U.S. Cl.
CPC ..... *A63G 31/02* (2013.01)

(58) Field of Classification Search
CPC . A63G 1/00; A63G 1/30; A63G 31/00; A63G 31/02; A63G 31/10; A63G 31/16
USPC ..... 472/2, 65, 67, 68, 131, 137
See application file for complete search history.

(56) References Cited

U.S. PATENT DOCUMENTS

| | | | | |
|---|---|---|---|---|
| 3,895,495 | A | 7/1975 | Kkazaki et al. | |
| 5,615,992 | A | 4/1997 | Proske et al. | |
| 5,765,314 | A | 6/1998 | Giglio et al. | |
| 5,845,434 | A | 12/1998 | Hayashi | |
| 6,629,895 | B2 | 10/2003 | Uemura et al. | |
| 8,057,317 | B2 | 11/2011 | Roodenburg et al. | |
| 8,795,096 | B2 | 8/2014 | Stoker | |
| 9,266,028 | B2 | 2/2016 | Alfieri et al. | |
| 9,302,190 | B1 | 4/2016 | Jennings | |
| 9,303,421 | B1 | 4/2016 | Jennings | |
| 9,732,535 | B2 | 8/2017 | Jennings | |
| 2014/0200087 | A1* | 7/2014 | Vatcher | A63G 31/02 472/131 |
| 2016/0184719 | A1* | 6/2016 | D'Andrea | F16M 11/045 700/275 |
| 2018/0311587 | A1 | 11/2018 | Freedman et al. | |

OTHER PUBLICATIONS

PCT/US2020/017732 International Search Report and Written Opinion dated May 26, 2020.

* cited by examiner

*Primary Examiner* — Kien T Nguyen
(74) *Attorney, Agent, or Firm* — Fletcher Yoder P.C.

(57) ABSTRACT

An amusement park system in accordance with present embodiments includes a tower having a central passage disposed therethrough, a ride vehicle disposed within the central passage, and a drive system coupled to the ride vehicle. The drive system is configured to displace the ride vehicle vertically within the central passage of the tower, and the tower is configured to rotate about the drive system.

21 Claims, 6 Drawing Sheets

SCENIC COMPARTMENT RIDE SYSTEMS AND METHODS

CROSS REFERENCES TO RELATED APPLICATIONS

This application is a continuation of U.S. Non-Provisional application Ser. No. 16/421,609, entitled "SCENIC COMPARTMENT RIDE SYSTEMS AND METHODS", filed on May 24, 2019, which claims priority from and the benefit of U.S. Provisional Application Ser. No. 62/805,191, entitled "SCENIC COMPARTMENT RIDE SYSTEMS AND METHODS," filed Feb. 13, 2019, which are hereby incorporated by reference in their entireties for all purposes.

BACKGROUND

The present disclosure relates generally to the field of amusement parks. More specifically, embodiments of the present disclosure relate to methods and equipment used in conjunction with amusement park rides.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Since the early twentieth century, amusement parks (or theme parks) have substantially grown in popularity. Certain amusement park rides may include a vertical ride system in which users are raised to have an overview of the amusement park and then lowered. However, the singular degree of freedom and limited views of such amusement park rides may limit an experience of a user. Accordingly, it is now recognized that an improved amusement park ride having a vertical heave motion with multiple degrees of freedom and a variety of viewing experiences may be desirable to enhance guest experience.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, an amusement park system includes a tower having a central passage disposed therethrough, a ride vehicle disposed within the central passage, and a drive system coupled to the ride vehicle. The drive system is configured to displace the ride vehicle vertically within the central passage of the tower, and the tower is configured to rotate about the drive system.

In an embodiment, a method includes rotating a tower about a central axis and displacing a ride vehicle vertically within a central passage of the tower via a drive system. The method further includes displacing the ride vehicle radially within the central passage of the tower relative to the central axis via a bogie system.

In an embodiment, an amusement park system includes a tower configured to rotate about a central axis, a drive mechanism configured to drive rotation of the tower about the central axis, and a ride vehicle disposed within a central passage of the tower. The amusement park system further includes a drive system configured to drive movement of the ride vehicle within the central passage of the tower. The amusement park system further includes, a controller having a memory device and a processor configured to execute instructions stored on the memory device. The instructions are configured to cause the processor to transmit a signal to the drive mechanism to cause the drive mechanism to drive rotation of the tower and transmit a signal to the drive system to cause the drive system to vertically displace the ride vehicle along the central axis.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
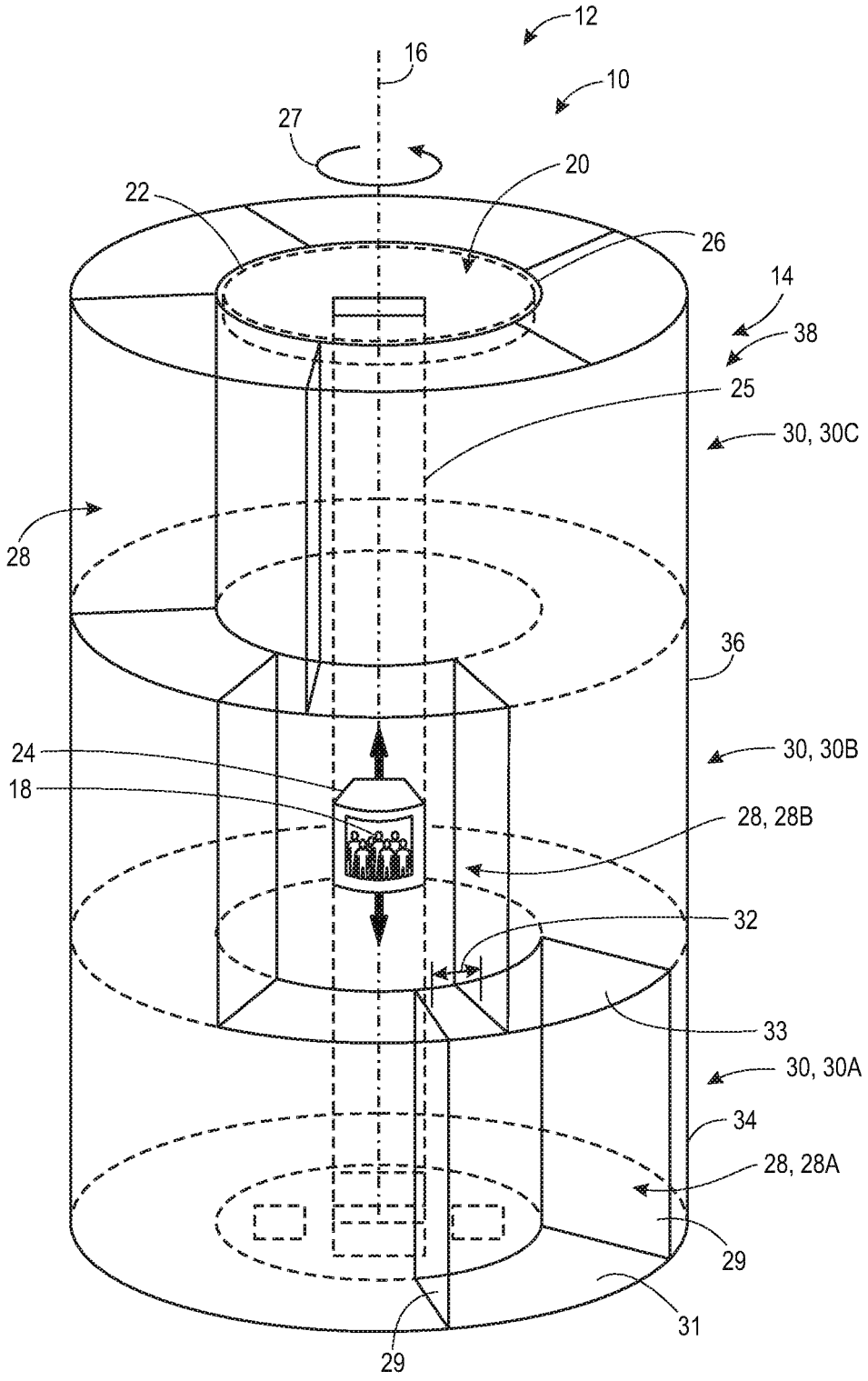
FIG. 1 is a perspective view of an embodiment of a tower of a ride system, in accordance with an aspect of the present disclosure.

The present disclosure provides, among other things, embodiments of a ride system having a rotatable tower and one or more ride vehicles configured to move with multiple degrees of freedom within a central passage or central region of the tower. The ride system exposes passengers (e.g., users) of the ride vehicles to a series of scenes as the ride vehicle moves vertically and as the tower rotates around the ride vehicle. Generally, amusement parks may include ride attractions that are configured to lift passengers via ride seats coupled to an external surface of a central structure. In such instances, the passengers may momentarily have a view of the surrounding environment before they are lowered to the ground and the ride ends. This type of attraction with the singular degree of freedom and the limited field of view generally limits the experience of the passengers. Accordingly, provided herein is a ride system that provides a multi-sensory narrative experience to passengers through exposure to various scenes while moving the passengers within a central passage or region of a rotating tower via a ride vehicle having multiple degrees of freedom. The varied movement of the ride vehicle and the exposure to various scenes of a narrative serve to enhance a thrill factor for the passengers.

Particularly, embodiments of the present disclosure include a ride vehicle configured to move, among other directions, vertically within a rotating tower. The tower includes multiple levels, and at least one level has multiple compartments having openings exposing the compartments from a viewpoint within the central passage or region (e.g., open toward the ride vehicle). Each compartment is configured to deliver a segment of a narrative to passengers within the ride vehicle via scene elements (e.g., special effects, media displays, animatronics, actors/actresses, sound systems) disposed within the compartments. In particular, the compartments are arranged such that rotation of the tower causes various compartments to move through a field of view of the passengers within the ride vehicle, thereby communicating segments of the narrative to the passengers. At the same time, the ride vehicle may be hoisted vertically within the passage to place the ride vehicle in a particular location relative to (e.g., adjacent to) compartments of various levels of the tower. For example, as a compartment is about to rotate past the ride vehicle, the ride vehicle may be vertically displaced within the tower to place the ride vehicle adjacent to an approaching compartment at another level, or elevation, within the tower. In this manner, as the ride vehicle moves vertically within the tower, and as the tower rotates, passengers within the ride vehicle may be exposed to a series of compartments, each communicating a segment of a narrative.

Further, in some embodiments, the ride vehicle may be configured to move with multiple degrees of freedom within the tower. For example, a drive system may be coupled to the ride vehicle in a manner that allows the drive system to move the ride vehicle along multiple directions. By way of non-limiting example, the drive system may include a winch system having at least one winch, and each of the at least one winch having a cable coupled thereto and to the ride vehicle. The winch system may be configured to selectively shorten or lengthen the amount of cable extending from each winch to cause the ride vehicle to pitch, roll, and be vertically displaced within the tower. The drive system may also include a bogie system. The bogie system may be coupled to the winch system and may be configured to move along a track extending, for example, radially relative to a central axis of the tower. However, the track may extend in another manner, for example as a secant relative to the annulus defining the interior passage or region of the tower. In this manner, the bogie system may also radially displace the ride vehicle within the tower.

With the foregoing in mind, FIG. 1 illustrates a perspective view of a ride system 10 (e.g., amusement park attraction) of an amusement park 12. The ride system 10 includes a tower 14 configured to be rotated about a central axis 16 (e.g., longitudinal) of the tower 14 to provide a scene-driven narrative or other experience to users 18. To illustrate, the tower 14 is configured to rotate about a central passage 20 defined by a substantially open area (e.g., an annulus) in a central area of the tower 14 (disposed about the central axis 16). A drive system 22 positioned within or proximate to the central passage 20 is configured to drive one or more ride vehicles 24 along a direction substantially parallel to the central axis 16 within the central passage 20. For example, as shown, the ride vehicle 24 may move within a vertical path 25 along the central axis 16. Further, the ride vehicle 24 may be configured to hold any suitable number of users 18 (e.g., passengers), such as one to ten users 18.

The ride vehicles 24 are oriented to face an interior circumference 26 (e.g., interior side) of the tower 14 to allow the users 18 within the ride vehicle 24 to view different areas of the tower 14, such as different scenes within the tower 14. The tower 14 further includes compartments 28 having, for example, various scenes oriented and exposed toward the central axis 16 from the interior circumference 26 of the tower 14. A scene may be defined as a representation of a segment of a narrative of the ride system 10. The scenes may communicate the segment of the narrative in any number of ways, such as through the use of actors/actresses, special effects, moving pictures, audio, animated figures, and so forth. In this manner, as the tower 14 rotates and the ride vehicles 24 are driven vertically within the central passage 20, the users 18 within the ride vehicles 24 may experience a narrative through exposure to a sequence of various scenes displayed via the compartments 28, as discussed herein. To this end, the tower 14 includes multiple levels 30 (e.g., floors), each of which may be divided into the compartments 28. Each compartment 28 may be defined by a recessed portion of the tower 14 (e.g., recessed with respect to the interior circumference 26). As an example, certain compartments 28 may be defined by two side walls 29, a floor 31, a ceiling 33, and a rear wall 34. The rear wall 34 may be the same as, or separate from, an external surface 36 of the tower 14. Indeed, each compartment 28 may be exposed or have an opening facing toward the central axis 16. While the current illustration has been simplified to show only one compartment 28 per level 30 in order to highlight certain aspects of the disclosure, it is to be understood that each level 30 may be divided into any suitable number of the compartments 28 distributed in a circumferential space of each respective level 30. For example, in some embodiments, each level 30 may include four or five compartments 28.

The tower 14 may rotate in any manner that suits the intended experience for the users 18, for example at varying speeds, at a constant speed, or in a manner where the tower 14 stops and starts rotation periodically. Further, rotation of the tower 14 may be controlled using suitable equipment, such as using one or more drives (e.g., motors), tracks, and so forth, and under the direction of one or more drive controls. As a specific example, rotation of the tower 14 may be controlled by a ride control system (RCS) that coordinates rotation of the tower 14 with various show effects presented within the tower 14. Such features are described in further detail below with respect to FIG. 2.

In certain embodiments, the tower 14 may continuously rotate at a constant speed while the ride vehicle 24 is hoisted vertically (e.g., upward and/or downward) within the central passage 20. The rotation of the tower 14 and the vertical movement of the ride vehicle 24 cooperatively serve to adjust the scenes to which the users 18 are exposed. For example, the drive system 22 may position the ride vehicle 24 at an elevation substantially equal to an elevation of a certain level 30. In doing so, the ride vehicle 24 may be positioned in front of a scene associated with a particular one of the compartments 28 of the certain level 30. Indeed, while the ride vehicle 24 is positioned in front of the scene, the scene may be moving relative to the ride vehicle 24 due to the rotation of the tower 14. The drive system 22 may hold the ride vehicle 24 at the elevation associated with the certain level 30 for a period of time (e.g., a predetermined period of time). Particularly, the drive system 22 may hold the ride vehicle 24 at the elevation associated with the certain level 30 until the rotation of the tower 14 has caused the certain compartment 28 to rotate past the ride vehicle 14, or until the users 18 of the ride vehicle 14 are obstructed from viewing the compartment 28 (e.g., due to the compartment 28 moving past the ride vehicle 24). In some embodiments, the drive system 22 may hold the ride vehicle 24 at the elevation associated with the certain level 30 until just before the rotation of the tower 14 has caused the compartment to rotate past the ride vehicle 24. At an end of the period of time, which may be associated with a conclusion of a segment of the narrative, the drive system 22 may hoist the ride vehicle 24 to a new level 30 to continue the narrative through exposure to a new scene.

To illustrate, the tower 14 may rotate in a counterclockwise direction 27 about the central axis 16, and the ride vehicle 24 may initially be held at a first elevation associated with a first level 30*a* of the tower 14. The ride vehicle 24 may be held at the first elevation while a first compartment 28*a* is adjacent to the ride vehicle 24. It should be noted that, as used herein, the compartment 28 being adjacent to the ride vehicle 24, or vice versa, may be defined as users 18 within the ride vehicle 24 having a substantially unobstructed view of an interior of the compartment 28. The compartment 28 being adjacent to the ride vehicle 24, or vice versa, may additionally or alternatively be defined as a circular sector associated with the compartment 28 or be defined by a portion of the interior circumference 26 that is associated with the compartment 28 relative to the central axis 16 overlapping in a radial direction of the tower 14 with the ride vehicle 24. While held adjacent to the first compartment 28*a*, the users 18 may experience a scene associated with the first compartment 28*a*. As the first compartment 28*a* moves past the ride vehicle 24, or is about to rotate past the ride vehicle 24, the drive system 22 may hoist the ride vehicle 14 to a second level 30*b* such that the ride vehicle 24 is held adjacent to a second compartment 28*b*. Particularly, in some embodiments, the drive system 22 may hoist the vehicle 24 to the second level 30*b* when a circular sector (e.g., relative to the central axis 16) of an overlap portion 32 between the first compartment 28*a* and the second compartment 28*b* coincides with the ride vehicle 24. Indeed, as currently illustrated, the ride vehicle 24 is held adjacent to the second compartment 28*b*. As described above, when the second compartment 28*b* rotates past the ride vehicle 24 or is about to rotate past the ride vehicle 24, the drive system 22 may hoist the ride vehicle 24 to a third level 30*c*. As an example, the ride vehicle 24 may be hoisted when an overlap portion 32 between the second level 30*b* and the third level 30*c* also overlaps with the ride vehicle 24.

The process described above may continue in a similar fashion until the ride vehicle 24 has reached a top level 38 of the tower 14. However, motion of the ride vehicle 24 is not limited in this manner, and the ride vehicle 24 may move with the vertical path in any suitable way. For instance, the ride vehicle 24 may be moved by the drive system 22 between the different levels 30 multiple times. With respect to the example where the ride vehicle 24 moves upward, once the drive system 22 has positioned the ride vehicle 24 adjacent to a compartment 28 at the top level 38 of the tower 14, and the compartment 28 at the top level 38 has rotated past or is about to rotate past the ride vehicle 24, the drive system 22 may lower the ride vehicle 24 to a lower level 30 and adjacent to a compartment 28 of the lower level 30. The process may continue in this manner until the drive system 22 places the ride vehicle 24 at a floor level 30 (e.g., level 30*a*), at which point the users 18 may disembark from the ride vehicle 24 and new users 18 may board the ride vehicle 24, as described in further detail below.

Indeed, each compartment 28 placed adjacent to the ride vehicle 24 may provide a scene that delivers a segment of a narrative to the users 18 of the ride vehicle 24. Accordingly, an entirety of the narrative may be provided to the users 18 as the ride vehicle 24 is hoisted to the various levels 30 and as the compartments 28 provide various scenes to the users 18. In some embodiments, the users 18 may experience a first half, or a first portion, of the narrative while travelling upward within the tower 14, and may experience a second half, or second portion, of the narrative while traveling downward within the tower 14. Further, as set forth above, in some embodiments transitioning the ride vehicle 24 from adjacent to a first compartment 28 to adjacent to a second compartment 28 may include traversing one or more levels 30 disposed between the first and second compartments 28. In other words, consecutive segments of a narrative may be delivered by scenes of compartments 28 that have one or more levels 30 disposed therebetween. In this manner, the drive system 22 may hoist the vehicle 24 at a faster speed and/or for a longer time period before arriving at the next compartment 28 of the narrative. Further, in some embodiments, the drive system 22 may take an indirect route to a successive compartment 28 of the narrative. For example, the drive system 22 may hoist the ride vehicle 24 upward and/or downward multiple times within the central passage 20 before placing the ride vehicle 24 adjacent to the successive compartment 28 in the narrative. In this way, the increased variation in vertical motion, or increase in speed, of the ride vehicle 24 may enhance an experience for the users 18. In some embodiments, the ride system 10 may utilize approximately five to ten compartments 28, or any suitable number of compartments 28, to deliver the narrative to the users 18.

Moreover, in some embodiments, the transition between the compartments 28 (e.g., due to the rotation of the tower 14 and the vertical movement of the ride vehicle 24) may coincide with a transitional effect provided by the compartment 28. Specifically, the transitional effect may serve to enhance an experience for the users 18 during transitions between scenes of the compartments 28. For example, the transitional effect may be a smoke effect, a light flashing effect, water effect, or other sensory stimulus. In certain embodiments, the transitional effect may be associated with the narrative. That is, the users 18 may interpret characters, or other elements, of the scene as having caused the transitional effect.

Figure 2:
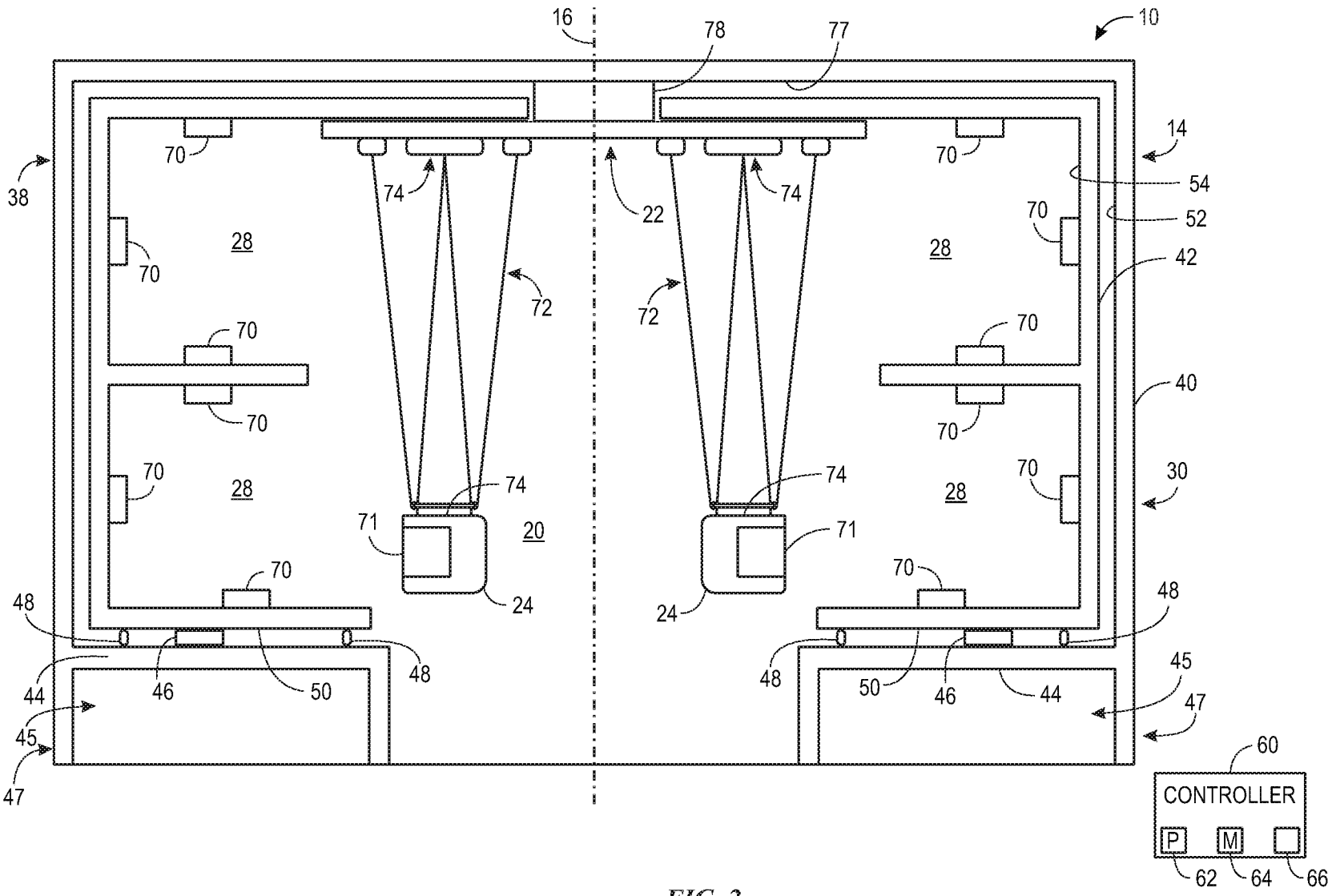
FIG. 2 is a cross-sectional side elevation view of the ride system of FIG. 1, in accordance with an aspect of the present disclosure.

FIG. 2 is a cross-sectional side elevation view of an embodiment of the ride system 10. As shown, the tower 14 of the ride system 10 may include an outer shell 40 (e.g., a stationary shell) and an inner shell 42 (e.g., a dynamic or rotational shell). The outer shell 40 is held stationary and is configured to support the inner shell 42 as the inner shell 42 rotates, as described above in FIG. 1 with reference to rotation of the tower 14. Particularly, in some embodiments, the outer shell 40 may encapsulate the inner shell 42 and provide a ledge 44 on which the inner shell 42 is supported in the vertical direction. The outer shell 40 may be formed of any suitable material to provide adequate support to the tower 14. In some embodiments, the outer shell 40 may include a lattice, or generally open, structure such that movement of the inner shell 42 may be observed from an external location of the tower 14, and/or to allow the users 18 to view an environment external to the ride system 10 through the inner and outer shells 40, 42.

The ledge 44, on which the inner shell 42 is at least partially supported, may provide for a loading passage 45 or loading zone. Particularly, the users 18 may enter the tower 14 through the loading passage 45 to board the ride vehicle 24. As shown, the loading passage 45 may be disposed directly beneath a first level 30 of the tower 14. In other words, the loading passage 45 may be on a ground level 47 of the tower 14. Indeed, a compartment 28 may be disposed above the loading passage 45 on an opposite side of the ledge 44. Further, in some embodiments, the loading passage 45 may extend circumferentially about the central passage 40 of the tower 14. In other embodiments, the loading passage 45 may include multiple separate channels, as discussed in further detail below with reference to FIG. 5. In such embodiments, the loading passage 45 may include at least as many channels as the number of ride vehicles 24 in the ride system 10.

The ride system 10 may further include one or more rotation (e.g., drive) mechanisms 46 configured to drive rotation of the inner shell 42 relative to the outer shell 40. The drive mechanism 46 may include a motor (e.g., an electric motor) and/or an engine configured to drive rotation of one or more drivers 48, or include wheels to drive the rotation of the inner shell 42. In certain embodiments, the drive mechanism 46 and the drivers 48 may be coupled to the ledge 44 of the outer shell 40. In this way, the drivers 48 may transfer rotational power to a base 50 of the inner shell 42, thereby causing the inner shell 42 to rotate. Additionally or in the alternative, the drive mechanism 46 and the drivers 48 may be coupled to the base 50 of the inner shell 42. In this way, the drivers 48 may transfer rotational power to the ledge 44 of the outer shell 40, thereby causing the inner shell 42 to rotate. Further, it is to be understood that the drive mechanism 46 may utilize any suitable drivers 48 disposed in any suitable location to drive rotation of the inner shell 42 relative to the outer shell 40. For example, in some embodiments, the drive mechanism 46 may include a track system and a bogie coupling the inner shell 42 and the outer shell 40 to drive the rotation. Moreover, in certain embodiments, the drive mechanism 46 may include drivers 48 disposed along an inner wall 52 of the outer shell 40 and/or along an outer wall 54 of the inner shell 42, to drive the rotation of the inner shell 42.

Functions of the drive mechanism 46, the drive system 22, and other assemblies/systems discussed herein may be controlled in response to signals transmitted from one or more controllers 60 (e.g., programmable logic controllers of a ride control system, or a show control system). The controller(s) 60 may employ a processor 62, which may represent one or more processors, such as an application-specific processor. The controller 60 may also include a memory device 64 storing instructions executable by the processor 62 to perform the methods and control actions described herein for the ride system 10. The processor 62 may include one or more processing devices, and the memory 64 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium that can be used to carry or store desired program code in the form of machine-executable instructions or data structures and which can be accessed by the processor 62 or by any general purpose or special purpose computer or other machine with a processor.

The controller 62 may utilize communication circuitry 66 to communicate with the drive mechanism 46, the drive system 22, and other assemblies/systems discussed. In some embodiments, the communication circuitry 66 may communicate through a wireless network, such as wireless local area networks [WLAN], wireless wide area networks [WWAN], near field communication [NFC], Wi-Fi, and/or Bluetooth. In some embodiments, the communication circuitry 66 may communicate through a wired network such as local area networks [LAN], or wide area networks [WAN].

By way of non-limiting example, the controller 60 may sync or provide timing control between the rotation of the inner shell 42 and the drive system 22. In this way, the ride vehicles 24 may be accurately positioned adjacent to predetermined compartments 28 at respective predetermined times in a ride cycle to fluidly communicate the narrative of the ride system 10 to the users 18. Similarly, as mentioned above, each compartment 28 may include scenic elements 70, which may include special effects, animated figures, media display systems, audio systems, and so forth, which may in certain situations be accompanied by actors/actresses. The controller 60 may sync, or provide timing control, to the scenic elements 70 of the compartment 28 to provide a segment of a narrative to the users 18 within the ride vehicle 24 while the ride vehicle 24 is positioned adjacent to the compartment 28. Similarly, at the end of the segment of the narrative, or when the compartment 28 is about to rotate past the ride vehicle 24, the controller 60 may cause one or more special effects of the scenic elements 70 to actuate. In some embodiments, the special effect of the scenic elements 70 may serve to distract the users 18 such that the attention of the users 18 is drawn away from viewing the side wall 29 (FIG. 1) of the compartment 28 as the compartment 28 rotates past the ride vehicle 24. Indeed, in some instances, having a view of the side wall 29 may serve to pull the users 18 from the sensory experience provided by the scenic elements 70 of the compartment 28. In other words, viewing the side wall 29 may cause the users 18 to be aware of an adjoined, or neighboring, compartment 28 which may detract from a ride experience of the users 18. In some embodiments, the special effects of the scenic elements 70 may include projectile effects, projected towards the ride vehicle 24, such as water, smoke, vapor, wind and so forth. Accordingly, in some embodiments, the ride vehicle 24 may include a window 71 configured to fully or partially shield the users 18 from the projected special effects. Additionally, or in the alternative, the ride vehicle 24 may not include the window 71 such that the users 18 may be immersed in the projected special effects, or have a more direct experience with the special effects. Indeed, in some embodiments, the window 71 may be retractable. In this manner, the users 18 may be immersed in some of the projected special effects, and may be shielded from some of the projected special effects.

As mentioned above, the drive system 22 is configured to heave the ride vehicle 24 vertically within the central passage 20 of the tower 14 for thrill purposes and/or to place the ride vehicle 24 adjacent to a compartment 28 to continue a narrative of the ride system 10. Additionally, the drive system 22 may be configured to pitch, roll, and yaw the ride vehicle 24 in accordance with the narrative, or a theme, of the ride system 10. To this end, in certain embodiments, the drive system 22 may include cables 72 that are coupled to a top 74 of the ride vehicle 24. The drive system 22 may further include a winch system 76 configured to retract and extend the cables 72 to cause the ride vehicle 24 to heave (e.g., vertical motion), pitch, and roll. In some embodiments, the drive system 22 may also include a bogie system 79 (e.g., a track and a bogie), shown in FIG. 3, configured to drive the ride vehicle 24 laterally, or in a radial direction relative to the central axis 16 of the tower 14. In this way, as discussed in further detail below, the users 18 may be placed closer to the scenic elements 70 to enhance the experience of the users 18. The bogie system 79 may also be configured to cause the ride vehicle 14 to yaw, or rotate within a horizontal plane. In this way, as discussed in further detail below, the ride vehicle 24 may be oriented to face a center of a compartment 28 while the ride vehicle 24 is placed adjacent to the compartment 28, thereby orienting and focusing a view of the users 18 toward a center of the compartment 28 adjacent to the ride vehicle 14.

As illustrated, in some embodiments, the drive system 22 may be disposed at an elevation within the tower 14 that is approximately equal to an elevation of the top level 38 of the tower 14. In other embodiments, the drive system 22 may be disposed vertically above the top level 38 of the tower 14. Generally, as shown, the inner shell 42 may be donut shaped, or have a substantially open area to define the central passage 20. Particularly, the drive system 22 may be coupled to an interior top surface 77 of the outer shell 40. In this manner, the drive system 22 may be held stationary against the outer shell 40 while the inner shell 42 rotates about the drive system 22. Further, in some embodiments, the drive system 22 may be configured to rotate relative to the outer shell 40. For example, in some embodiments, the drive system 22 may be coupled to the interior top surface 77 of the outer shell 40 via a rotational system 78 that is configured to drive rotation of the drive system 22 relative to the outer shell 40.

Figure 3:
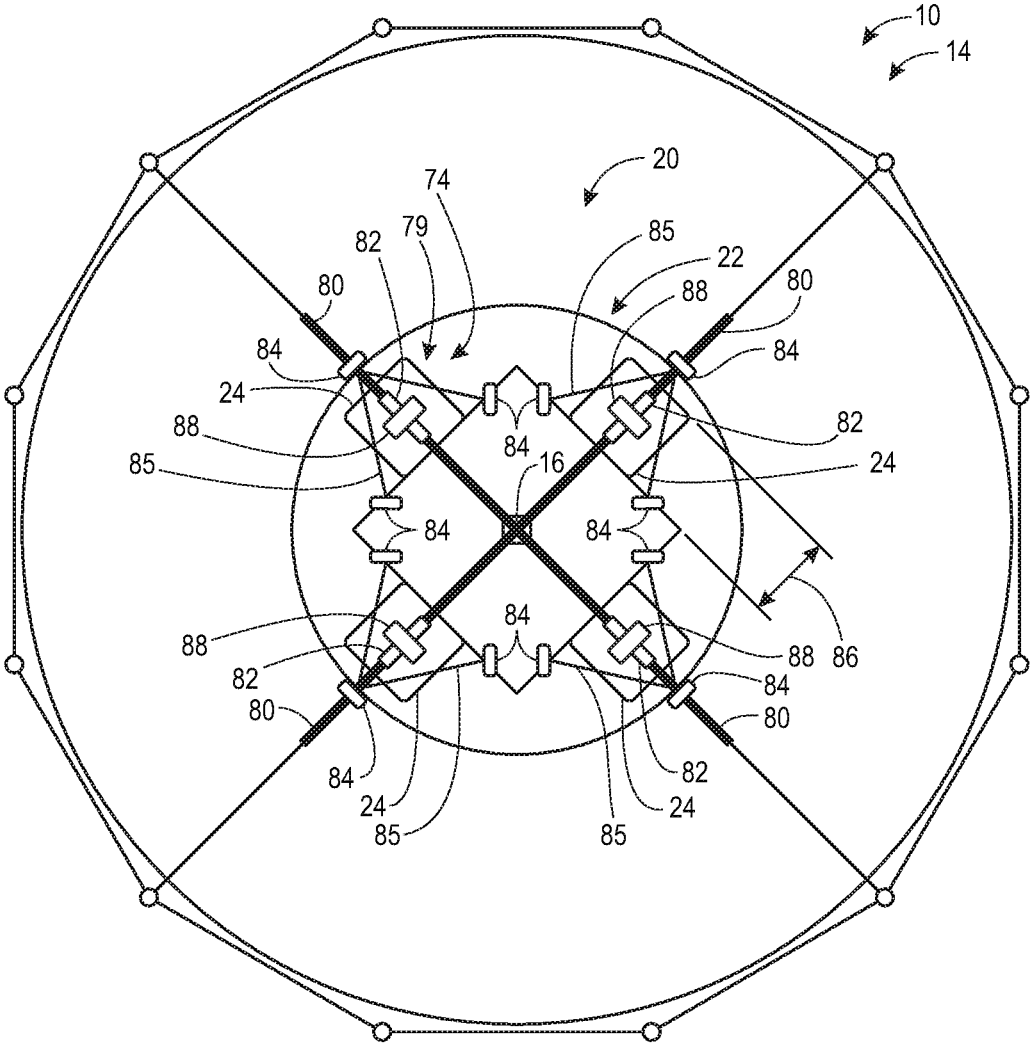
FIG. 3 is a cross-sectional overhead view of the ride system of FIG. 1, in accordance with an aspect of present disclosure.

Keeping this in mind, FIG. 3 is an overhead view of the tower 14. As discussed above, the drive system 22 is configured to drive movement of the ride vehicle 24 within the central passage 20 of the tower 14. The drive system 22 includes the bogie system 79, which further includes a track 80 and a bogie 82 coupled to each ride vehicle 24. The bogie 82 is configured to move along the track 80 to radially displace the ride vehicle 24 relative to the central axis 16. The drive system 22 further includes the winch system 74, which may include three or more winch drives 84, each configured to retract and extend the cables 72 (FIG. 2) that are coupled to the ride vehicle 24. The winch drives 84 may be mounted to the bogie 82 via a frame 85 (e.g., a v-frame). Indeed, as shown, the winch drives 84 may be disposed circumferentially about the bogie 82 while supported by the frame 85. In other words, the frame 85 may couple the winch drives 84 to the bogie 82.

The winch drives 84 are configured to heave, pitch, and roll the ride vehicle 24. Particularly, in response to signals transmitted from the controller 60, each of the winch drives 84 are configured to selectively extend/lengthen and retract/shorten the cable 72 to heave, pitch, and roll the ride vehicle 24. Indeed, in certain embodiments, each winch drive 84 may include a spool configured to hold the cable 72, and a motor configured to rotate the spool. The motor may rotate the spool to either extend the cable 72 from the spool or retract the cable 72 onto the spool, depending on a direction of rotation of the spool.

For example, to pitch the ride vehicle 24 forward, one or more winch drives 84 disposed in front of the ride vehicle 24 may extend respective cables 72 while one or more winch drives 84 disposed behind the ride vehicle 24 may retract respective cables 72, thereby pitching the ride vehicle 24 forward. The winch drives 84 may function in an opposite manner to pitch the ride vehicle 24 backward. As a further example, to roll the ride vehicle 24 to the right, one or more winch drives 84 disposed on a right side of the ride vehicle 24 may expel respective cables 72 while one or more winch drives 84 disposed on a left side of the ride vehicle 24 may retract respective cables 72, thereby rolling the ride vehicle 24 to the right. The winch drives 84 may function in an opposite manner to roll the ride vehicle 24 to the left. Moreover, to increase an elevation of the ride vehicle 24 within the tower 14, all of the winch drives 84 may retract respective cables 72. Similarly, to decrease an elevation of the ride vehicle 24 within the tower 14, all of the winch drives 84 may extend respective cables 72. In the currently illustrated embodiment, the winch system 74 includes three winch drives 84 per ride vehicle 24. However, it is to be understood that the winch system 74 may include any suitable number of winch drives 84 per ride vehicle 24, such as four or six winch drives 84 per ride vehicle 24.

Moreover, as mentioned above, the bogie 82 is configured to move along the track 80 to displace the ride vehicle 24 radially relative to the central axis 16 of the tower 14 in response to signals transmitted from the controller 60. Specifically, the radial movement of the ride vehicle 24 along the track 80 may move the ride vehicle 24 towards a compartment 28. In this manner, the users 18 may be placed directly adjacent to the compartment 28 while experiencing the narrative segment of the compartment 28. Indeed, the closeness of the user 18 relative to the scenic elements 70 of the compartment 28 serves to enhance the user's 18 experience. At the end of the narrative segment of the compartment 28, or when the compartment 28 is about to rotate past the ride vehicle 24, the bogie system 79 may retract the ride vehicle 24 along the track 80 away from the compartment 28 before the drive system 22 places the ride vehicle 24 adjacent to another level 30 to continue the narrative.

In some embodiments, the displacement distance of the radial movement of the ride vehicle 24 along the track 80 may be limited. For example, the ride vehicle 24 may be associated with a length 86 that is generally oriented radially with respect to the axis 16. Accordingly, the bogie system 79 may radially displace the ride vehicle 24 a maximum distance equal to approximately two to four lengths of the ride vehicle 24. The limited radial displacement distance of the bogie 82 along the track 80 may minimize an amount of sway, or oscillation, experienced by the ride vehicle 24 caused as a result of the radial movement. Further, in some embodiments, as may be observed in FIG. 1, the floors 31 and/or ceilings 33 of the compartments 28 may serve to limit the radial displacement distance. Particularly, the limited radial displacement distance of the bogie 82 along the track 80 may be limited to prevent the cables 72 from contacting the floors 31 and/or ceilings 33 of the compartments 28.

In some embodiments, the winch system 74, which supports the ride vehicle 24 via the cables 72, may be rotated relative to the bogie 82 to rotate, or yaw, the ride vehicle 24. For example, in some embodiments, the drive system 74 may include a rotary actuator 88 configured to cause rotation of the frame 85 relative to the bogie 82 in response to signals from the controller 60. Particularly, the ride vehicle 24 may be rotated to generally face the compartment 28 that is adjacent to the ride vehicle 24. In some embodiments, rotation of the ride vehicle 24 may be synced, or matched, with the rotation of the tower 14. In this manner, the users 18 within the ride vehicle 24 may not be able to perceive the rotation of the tower 14 relative to the ride vehicle 24. Indeed, it may appear to the users 18 as though the ride vehicle 24 and the tower 14 are being held stationary since the relative motion of the tower 14 and the ride vehicle 24 may be difficult to observe from within the ride vehicle 24.

Figure 4:
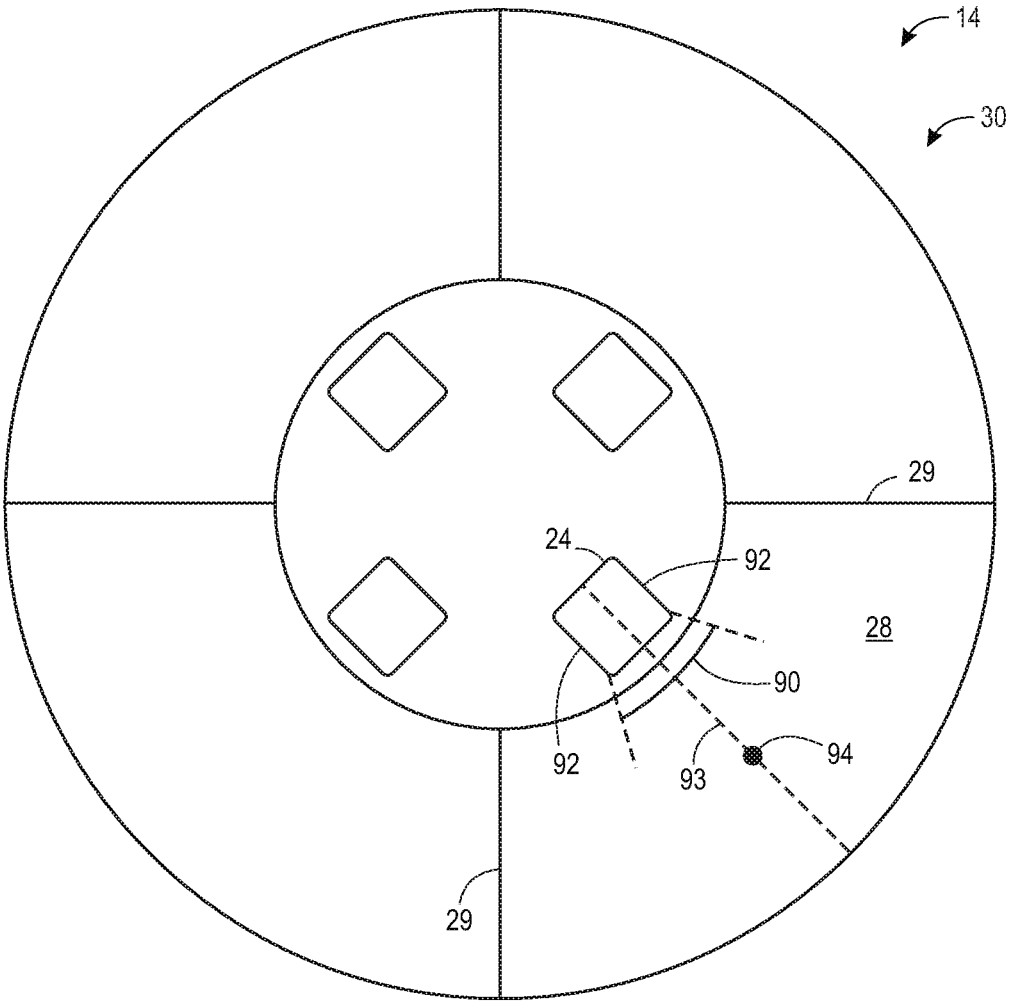
FIG. 4 is an overhead view of the ride system of FIG. 1, in accordance with an aspect of present disclosure.

To further illustrate, FIG. 4 is a schematic overhead view of a level 30 of the tower 14. As shown, a ride vehicle 24 may be placed adjacent to one of the compartments 28 of the level 30. In some embodiments, the ride vehicle 24 may be associated with a field of view 90. The field of view 90 is associated with the area to which the users 18 disposed within the ride vehicle 24 are visibly limited to. For example, sides 92 of the ride vehicle 24 may serve to block the users 18 from viewing features of the ride system 10 that are outside of the field of view 90. As mentioned above, in certain situations the ride vehicle 14 may be rotated in a manner to substantially match the rotation of the tower 14. In this manner, it may be difficult for the users 18 to perceive the relative motion between the tower 14 and the ride vehicle 24. Particularly, as shown, in some embodiments, the ride vehicle 24 may be rotated such that a center 93 of the field of view 90 of the ride vehicle 24 remains substantially collinear with a middle point 94 of the compartment 28. However, it should be understood that the ride vehicle 24 may be rotated such that the center 93 continuously faces any suitable point within the compartment 28, such as a focal point associated with scene elements 70 of the compartment 28. Indeed, the focal point of the scene elements 70 may be off-center from the middle point 94 of the compartment 28.

Further, in some embodiments, the ride vehicle 24 may be rotated such that the field of view 90 of the ride vehicle 24 does not overlap with the side walls 29 of the compartment 28. To this end, in some embodiments, the ride vehicle 24 may only rotate as necessary to prevent the field of view 90 from overlapping with the side walls 29. Indeed, as mentioned previously, the users 18 having a view of the side walls 29 may serve to detract from an experience of the users 18.

Figure 5:
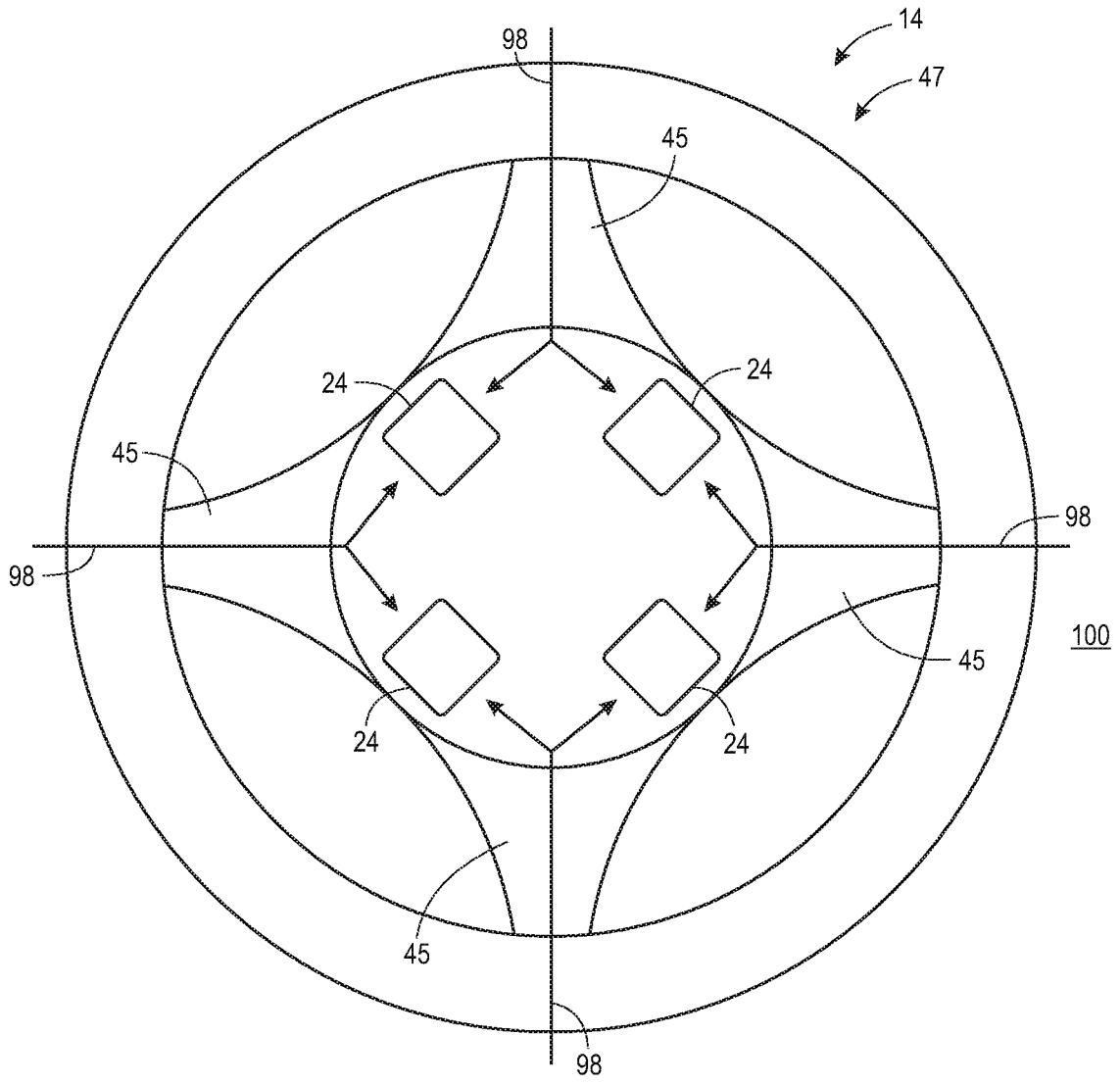
FIG. 5 is an overhead view of the ride system of FIG. 1, in accordance with an aspect of present disclosure.

As discussed previously, the winch system 74 may heave the ride vehicle 24 vertically within the tower 14. Specifically, the winch system 74 may lower the ride vehicle 24 to the ground level 47 such that the users 18 can board and disembark from the ride vehicle 24, although boarding and disembarking may occur at levels other than the ground level 47, and not necessarily at the same level. Keeping this in mind, FIG. 5 is a partial overhead view of the ground level 47. As shown, the ground level 47 includes the loading passage 45. Users 18 may enter the tower 14 through the loading passage 45 and board the ride vehicles 24, as illustrated by arrows 98. Indeed, the loading passage 45 may connect a surrounding area 100 of the tower 14 to the central passage 20 in which the ride vehicles 24 are disposed. In the currently illustrated embodiment, the tower 14 includes four separate loading passages 45. However, it is to be understood that the tower 14 may include any suitable number of the loading passages 45. In some embodiments, the loading passage 45 may form a continuous ring about the central passage 20 of the tower 14 such that the loading passage 45 does not include multiple separated loading passages 45.

Figure 6:
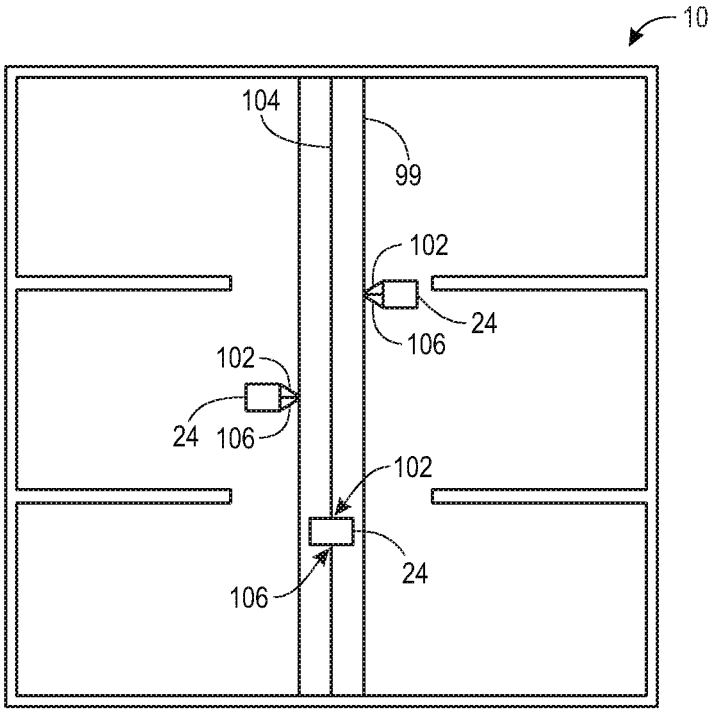
FIG. 6 is a cross-sectional schematic side view of the ride system of FIG. 1, in accordance with an aspect of the present disclosure.

FIG. 6 is a cross-sectional view of an embodiment of the ride system 10 having a drive column 99 (e.g., a central column) configured to drive the ride vehicles 24 vertically within the central passage 20, as described herein. For example, the drive column 99 may extend from the ground level 47 to the top level 38 along the central axis 16 of the tower 14. It should be noted that the illustrations of FIG. 6 have been intentionally simplified to focus on aspects of the drive column 99. Indeed, the embodiments of the ride system 10 of FIG. 6 may function as described above in reference to FIGS. 1-5, except that the movement of the ride vehicles 14 may be caused in response to input from the drive column 99, as opposed to the drive system 22 (FIGS. 1-5). In the current embodiment, the ride vehicles 24 may be cantilevered from the drive column 99 via one or more support beams 102. In some embodiments, the support beams 102 may be telescopic such that the support beams 102 are configured to be actuated to extend or retract. Indeed, the retraction and/or extension of the support beams 102 may serve to pitch, roll, and yaw the ride vehicles 24 relative to the drive column 99. Further, the drive column 99 may include tracks 104 on which the ride vehicles 24 are configured to move along. For example, the support beams 102 may be coupled to a bogie 106 (e.g., the bogie 82) configured to move along the track 104, thereby imparting the vertical motion to the ride vehicle 24, as described herein. In some embodiments, the drive column 99 may be configured to rotate about the central axis 16, thereby imparting rotation to the ride vehicles 24 about the central axis 16. Specifically, in some embodiments, the drive column 99 may rotate additionally or alternatively to the drive mechanism 46 rotating the tower 14.

Figure 7:
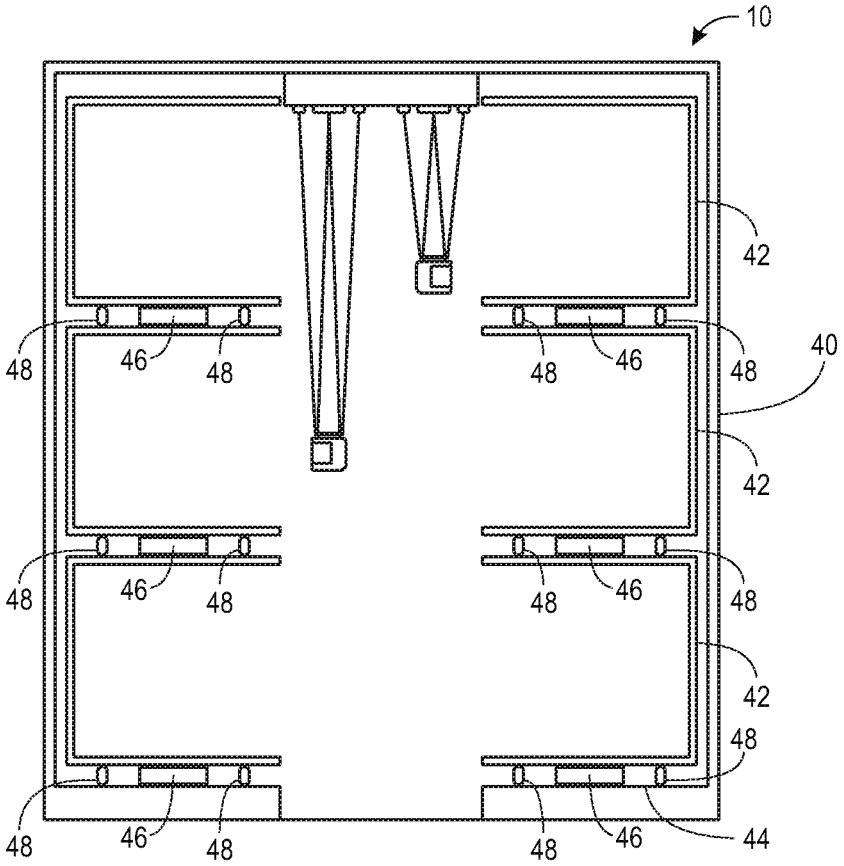
FIG. 7 is a cross-sectional schematic side view of the ride system of FIG. 1, in accordance with an aspect of the present disclosure.

FIG. 7 is a cross-sectional view of an embodiment of the ride system 10 having multiple drive mechanisms 46 configured to selectively rotate the levels 30 of the tower 14. Like FIG. 6, the illustrations of FIG. 7 have been intentionally simplified to focus on aspects of the multiple drive mechanisms 46. Indeed, embodiments of the ride system 10 of FIG. 7 may function similarly to the embodiments described above with reference to FIGS. 1-5. However, the ride system 10 may include multiple drive mechanisms 46 and associated drivers 48 configured to rotate each level 30 independently of each other. Particularly, the ride system 10 may include at least one drive mechanism 46 and at least one associated driver 48 disposed between each level 30 of the tower. In this manner, the controller 60 may selectively actuate the drive mechanisms 46 to drive rotation of the levels 30 of the inner shell 42 at respective speeds.

It should be understood that features of any of the embodiments discussed herein may be combined with any other embodiments or features discussed herein. By way of non-limiting example, the various drive mechanisms and drive systems described herein may be used singularly or in combination, and may be controlled in a coordinated manner. By way of further non-limiting example, the ride vehicles may be controlled and moved in any suitable manner as described herein, using any one or a combination of the features set forth herein with respect to effecting motion of the ride vehicles.

While only certain embodiments have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . " it is intended that such elements are to be interpreted under 35 U.S.C. § 112(f). However, for any claims containing elements designated in any other manner, it is intended that such elements are not to be interpreted under 35 U.S.C. § 112(f).

The invention claimed is:

1. An amusement park system, comprising:

a tower having a central axis extending vertically through the amusement park system;

a drive column comprising a track extending vertically through a plurality of levels along the central axis;

a ride vehicle configured to be displaced vertically along the track with respect to the central axis to the plurality of levels along the central axis; and one or more scenic elements configured to communicate a narrative to users within the ride vehicle, wherein the one or more scenic elements are disposed at least partially circumferentially about the ride vehicle at a level of the plurality of levels;

wherein the drive column is configured to displace the ride vehicle vertically along the track with respect to the central axis.

2. The amusement park system of claim 1, wherein the one or more scenic elements comprise an animated figure, a special effect, a sound system, a media display, or a combination thereof.

3. The amusement park system of claim 1, wherein the one or more scenic elements are configured to move in conjunction with the ride vehicle.

4. The amusement park system of claim 1, wherein the drive column is configured to displace the ride vehicle in multiple degrees of freedom with respect to the central axis.

5. The amusement park system of claim 1, comprising a support beam coupled to the track and to the ride vehicle, wherein the support beam is configured to cause the ride vehicle to pitch, roll, and yaw with respect to the central axis.

6. The amusement park system of claim 1, comprising a bogie system having a bogie coupled to the track and to the ride vehicle, wherein the bogie is configured to move along the track to displace the ride vehicle radially with respect to the central axis.

7. The amusement park system of claim 1, wherein the drive column is configured to rotate with respect to the central axis.

8. An amusement park system, comprising:

a tower having a central axis extending vertically through the amusement park system;

a drive column comprising a track extending vertically through a plurality of levels along the central axis;

a ride vehicle configured to be displaced vertically along the track with respect to the central axis to the plurality of levels along the central axis; and one or more scenic elements configured to communicate a narrative to users within the ride vehicle, wherein the one or more scenic elements are disposed at least partially circumferentially about the ride vehicle at a level of the plurality of levels;

wherein the drive column is configured to displace the ride vehicle in multiple degrees of freedom with respect to the central axis.

9. The amusement park system of claim 8, wherein the one or more scenic elements comprise an animated figure, a special effect, a sound system, a media display, or a combination thereof.

10. The amusement park system of claim 8, wherein the one or more scenic elements are configured to move in conjunction with the ride vehicle.

11. The amusement park system of claim 8, wherein the drive column is configured to displace the ride vehicle vertically along the track with respect to the central axis.

12. The amusement park system of claim 8, comprising a support beam coupled to the track and to the ride vehicle, wherein the support beam is configured to cause the ride vehicle to pitch, roll, and yaw with respect to the central axis.

13. The amusement park system of claim 8, comprising a bogie system having a bogie coupled to the track and to the ride vehicle, wherein the bogie is configured to move along the track to displace the ride vehicle radially with respect to the central axis.

14. The amusement park system of claim 8, wherein the drive column is configured to rotate with respect to the central axis.

15. An amusement park system, comprising:

a tower having a central axis extending vertically through the amusement park system;

a drive column comprising a track extending vertically through a plurality of levels along the central axis;

a ride vehicle configured to be displaced vertically along the track with respect to the central axis to the plurality of levels along the central axis, and to move in multiple degrees of freedom with respect to the central axis; and a media display configured to communicate a narrative to users within the ride vehicle, wherein the media display is disposed at least partially circumferentially about the ride vehicle at a level of the plurality of levels.

16. The amusement park system of claim 15, wherein the narrative is configured to move in conjunction with the ride vehicle.

17. The amusement park system of claim 15, wherein the drive column is configured to displace the ride vehicle vertically along the track with respect to the central axis.

18. The amusement park system of claim 15, wherein the drive column is configured to displace the ride vehicle in multiple degrees of freedom with respect to the central axis.

19. The amusement park system of claim 15, comprising a support beam coupled to the track and to the ride vehicle, wherein the support beam is configured to cause the ride vehicle to pitch, roll, and yaw with respect to the central axis.

20. The amusement park system of claim 15, comprising a bogie system having a bogie coupled to the track and to the ride vehicle, wherein the bogie is configured to move along the track to displace the ride vehicle radially with respect to the central axis.

21. The amusement park system of claim 15, wherein the drive column is configured to rotate with respect to the central axis.

* * * * *